US007055513B1

(12) United States Patent
Boveia

(10) Patent No.: US 7,055,513 B1
(45) Date of Patent: Jun. 6, 2006

(54) SPACER PLATE FOR USE WITH INTERNAL COMBUSTION ENGINES

(76) Inventor: John Boveia, 304 Smokey La., North Little Rock, AR (US) 72117

( * ) Notice: Subject to any disclaimer, the term of this patent is extended or adjusted under 35 U.S.C. 154(b) by 26 days.

(21) Appl. No.: 10/994,324

(22) Filed: Nov. 23, 2004

(51) Int. Cl.
*F02M 29/00* (2006.01)

(52) U.S. Cl. ..... 123/590; 123/337

(58) Field of Classification Search ..... 123/337, 123/590, 592
See application file for complete search history.

(56) References Cited

U.S. PATENT DOCUMENTS 4,482,093 A * 11/1984 Hafner et al. ..... 239/73

6,338,335 B1 * 1/2002 Patterson et al. ..... 123/590

* cited by examiner

*Primary Examiner*—Tony M. Argenbright
*Assistant Examiner*—Katrina Harris

(57) ABSTRACT

A device for use in an air intake path of an internal combustion engine to improve the engine performance. The device body has a top surface, bottom surface and at least one air passage defined about an axis from the top surface-to the bottom surface, containing a chamfer at each end. The upper portion of the passage surface contains a plurality of V-shaped veins about the axis of the passage. The lower portion of the passage narrows in diameter to a point equal to or greater than the vein extension in the upper portion. The lower portion also defines a grooved surface starting at it's beginning having a 60 degree slope edge and a flat bottom major diameter spaced in such a manner as to have a helical shape and to circumscribe the passage wall terminating prior to the end of the lower passage.

4 Claims, 3 Drawing Sheets

SPACER PLATE FOR USE WITH INTERNAL COMBUSTION ENGINES

CROSS REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

FIELD OF INVENTION

This invention relates to a throttle body spacer plate for any and all internal combustion engines, specifically an incorporation of specially designed structures located within the air passage(s) of the device, that improves internal combustion engine performance with increased gas mileage, lower fuel emissions, increased horse power and torque.

BACKGROUND OF THE INVENTION

The use of various devices for after market insertion into the intake path of internal combustion engines is well know in the prior art. Such devices are alleged to increase fuel economy, improve torque and pulling power of a vehicle, improve throttle response, improve fuel atomization resulting in greater combustion efficiency, etc.

Historically, spacer plates, sometimes referred to as spacer blocks, were originally used to separate a conventional carburetor from the engine's intake manifold to provide for additional flow of the fuel/air mixture into the intake manifold, and ultimately into the internal combustion chamber of the engine found in automobiles. A review of previous inventions reveals that the number and size of passages in spacers is generally determined by the number and the size of the outlets and inlets in the carburetor, throttle body injector or throttle body, as opposed to the intake manifold of the application. Various other devices positionable between the carburetor and intake manifold of an internal combustion engine are used to intercept the air or air/fuel mixture. Generally, the devices operate on the flow by imparting an electrostatic charge, by physically chopping the mixture to more finely divide the fuel particles, and/or by manipulating the flow in some manner to change the flow of the mixture through the passage. In general terms, the number and size of passages in spacers is generally determined by the number and the size of the outlets and inlets in the carburetor, throttle body injector or throttle body, as opposed to the intake manifold of the application.

In past years, the carburetor was routinely fitted with an air cleaner to cleanse the incoming outside air, with such air cleaner attached directly to the carburetor device. The customary design involved a down-flow system and the distance between the air cleaner device and the intake manifold was relatively short and the use of the spacer plate increased the distance allow the incoming air/fuel charge, or wet mixture, to increase velocity prior to its' passage through the throttle control valve, and entry into the intake manifold.

The second purpose was to provide heat insulation from the engine. Consistent with these goals, this generation of spacer plates served to improve the relative efficiency of the internal fuel combustion.

As automotive technology continued to develop through the years, the conventional carburetor was replaced by the throttle body injection unit which was more efficient in its introduction of fuel into the incoming air charge, while at the same time utilizing electronically controlled fuel injectors providing computer enhanced adjustment of the air/fuel charge, and other aspects of the internal combustion engines performance while the engine was in operation. This design allowed the injectors to introduce fuel into the incoming air stream, but before the air/fuel mixture, or wet mixture, passed through the throttle control valve and entered the intake manifold. As with the earlier carburetor configuration, the throttle body injector incorporated a down flow system and the distance between the air cleaner device and the intake manifold was relatively short. This era of spacer plate increased the distance allowing the incoming air/fuel charge, or wet mixture, to increase velocity prior to its' passage through the throttle control valve and to reduce heat transfer to from the heated intake manifold.

With the advent of more sophisticated electronic control devices, and more complex on board computers designed to increase the overall performance of the automobile, the next generation of throttle bodies incorporated a "dry system." In basic terms, the incoming air first passed through an air cleaner which was customarily located some distance from the intake manifold. A tube or specially designed air passageway then transported the incoming air through the throttle control valve. The air then passed into the engines' specially designed intake manifold for introduction into the actual combustion chamber. Fuel was injected into the air charge immediately prior to its' entry into the combustion chamber for ignition.

As stated earlier, the use of a form of the spacer plate in an automobile is varied. By way of example of the "wet system" technology, U.S. Pat. No. 4,415,507 issued to Voliva discloses a throttle body spacer plate that incorporates a mixing valve for a fuel carburetor. U.S. Pat. No. 3,645,243 entitled, "Fuel Mixing and Vaporizing Device for Internal Combustion Engines," issued to Ohlsson on Feb. 29, 1972, discloses a fuel mixing and vaporizing devise utilizing, among other things, the heat of the engine. U.S. Pat. No. 4,215,663 to Gaylord discloses an air fuel inlet device located within a throttle body spacer plate for an internal combustion engine. U.S. Pat. No. 4,667,648 to Beldin discloses a vaporizer within a throttle body spacer plate. U.S. Pat. No. 4,043,306 to Abbott discloses a carburetor throttle body spacer plate with a vapor fuel inlet. U.S. Pat. No. 4,086,899 to Gaylord discloses an air inlet device for an internal combustion engine. U.S. Pat. No. 4,711,225 to Holderle, et al, entitled, "Connecting Piece Between the Carburetor and the Combustion Chamber of an Internal Combustion Engine," issued Dec. 8, 1987, discloses a connecting piece between a carburetor and the combustion chamber. U.S. Pat. No. 5,619,960 to Funk is a throttle body spacer plate kit consisting of the throttle body spacer plate itself, gaskets, and bolts for attaching said block to the internal combustion engine's intake manifold. Finally, U.S. Pat. No. 6,338,335 issued to Patterson/Brown discloses a throttle body spacer plate for use in either a "wet system" or "dry system". This device contained continuously grooved apertures alleged to swirl the incoming air, or air/fuel mixture, to increase the performance of an engine.

The above designs and uses of the throttle body spacer plate differ substantially from the present invention. Of the above, U.S. Pat. No. 4,086,899 to Gaylord, U.S. Pat. No. 4,215,663 to Gaylord, and U.S. Pat. No. 5,619,960 to Funk, though differing substantially from the present invention, reflect a similar stated purpose to improve automobile engine performance and efficiency. These devices alleged to decrease fuel consumption and exhaust emissions, while increasing horsepower and torque. These goals are achieved by improving the combustion of fuel through the mixture of fuel and air. U.S. Pat. No. 4,086,899 to Gaylord; U.S. Pat. No. 4,115,663 to Gaylord; U.S. Pat. No. 5,619,960 to Funk each use a throttle body spacer plate to increase air velocity, or use of an air/fuel inlet within the throttle body spacer plate structure to again mix the components for introduction into the intake manifold.

The present invention differs substantially in its design and function of prior throttle body spacer plates. The apertures found in the throttle body spacer plate described above in Funk, are smooth surfaces. The incoming air charge passes through these apertures into the intake manifold. The increased distance created by the spacing plate allows the incoming air charge to increase velocity as it enters into the intake manifold. Therefore, the throttle body spacer plate only provides "extra" space which allows the incoming air charge to increase velocity through inertia.

The main disadvantages of all throttle body spacer plates heretofore known are evident from their design. As disclosed in U.S. Pat. No. 6,338,335 issued to Patterson/Brown, the now standard use of fuel injection technology and dry air manifolds eliminate the need for air/inlet devices as found in U.S. Pat. No. 4,086,899 to Gaylord and U.S. Pat. No. 4,215,663 to Gaylord as they were developed for use in the then prevalent wet manifolds. U.S. Pat. No. 5,619,960 to Funk provides no means by which to either directly increase the velocity of the air charge or to turbinate the air charge. While U.S. Pat. No. 6,338,335 issued to Patterson/Brown alleged that a top to bottom helix groove both increased the velocity of the air charge and swirled the air flow, this device failed to address current trends in internal combustion engineering. As a practicle matter, wet system technology differs substantially from dry system applications. While Patterson/Brown claimed to introduce an turbulence to the incoming air, the resulting turbulence diminished the design characteristics of the engine manufacture's intake manifold and piston/combustion chamber design. In addition, as the air velocity increased, the device favored only the narrow low band RPM operating range, and became ineffective in the high band RPM operating range due to the lack the device's ability to generate proper and effective manipulation of the air flow.

The spacer plates heretofore devised and utilized for the purpose of a throttle body spacer plate are known to consist basically of familiar, expected, and obvious structural configurations, notwithstanding the vast array of designs for any and all internal combustion engines encompassed by the crowded prior art that has been developed for the fulfillment of countless objectives and requirements.

Contrary to past developments in the internal combustion engine, recent developments in internal combustion design have been directed toward the major automobile manufactures' implementation of "fast burn" intake manifold and combustion technology in factory stock engines. The purpose of these developments was to deliver a more homogenous mixture directly into combustion chamber and delivering as much of the mixture as possible to the isolated volume of chamber space prior to and during ignition. Specific placement of the fuel mixture in this method results in a quicker and more complete burn. Factory engineered air flow patterns to promote rapid combustion are now generated through intake manifold design, and/or the structure and design of the piston and combustion chamber of the engine itself.

However, based on the prior art, the present invention substantially departs from the conventional concepts and designs of the prior art in scope and in function, and in doing so provides an apparatus primarily developed for preparation of the air for introduction of fuel immediately prior to the mixtures introduction into the combustion chamber with the purpose of increasing gas mileage, increasing horse power, increasing torque, and reducing emissions for any and all modern internal combustion engines. Additionally, the present invention is more compatible with existing intake manifold and piston/combustion chamber technology and works with, and not contrary to, the design and operational concepts of the engine manufacture.

Thus, there is an apparent need for an improved throttle body spacing plate that can increase gas mileage, increase horsepower, increase torque, and reduce emissions. Based upon these qualities, the present invention substantially fulfills these needs.

SUMMARY OF THE INVENTION

The present invention, as described below, addresses the problems discussed above and other problems, which will become apparent to one skilled in the art. Generally, the present invention provides a spacer plate having a particular air flow passage configuration, which improves engine performance, decreases fuel consumption and provides for better gas mileage, results in more end torque, more horsepower, and other various functions that will become apparent from the description below. Generally, the present invention provides a spacer having a particular air flow passage configuration which improves engine performance, decreases fuel consumption (i.e., provides for better gas mileage), may result in more torque, easier starting, more horsepower, and other various functions which will become apparent from the description below.

The present invention is a device for use in an intake path of an internal combustion engine which includes a body portion having a top surface and a bottom surface. The body portion further includes at least one passage surface defining at least one passage about an axis from the upper surface to the lower surface. The air passage surface contains two distinctive geometric designs described as follows. The upper portion of the passage surface shall contain an initial 30 to 45 degree chamfer with the outside diameter surface larger than the inside diameter of the lower portion described below.

After the initial chamfer, the upper portion of the passage surface shall thereafter consist of two individual and distinct surfaces about the axis of the passage. The upper portion of the passage surface thereafter contains multiple symmetrical vanes which run parallel to the center axis which end at the termination of the upper portion of the passage surface. The formation of these vanes consists of the joiner of U-shaped passages existing in the passage surface and which likewise run parallel to the center axis from the top surface of the passage surface to the termination of the upper portion of the passage surface. The upper portion of the air flow passage establishes an unobstructed, but directed, flow of air for introduction to the remaining portion of the passage described below.

The second, or lower, portion of the air passage contained in the present invention contains a passage with an inner diameter smaller than the first portion which shall protrude into the passage at a depth at least equal to the distance of the vane extension contained in the upper portion of the passage described above. In the example embodiment, the upper and lower portions shall be equal in distance through the total air passage. The lower portion of the air passage further defines a grooved surface beginning at the termination of the vanes and U-shaped passages contained in the upper portion of the air passage, such grooved surface having a helical shape having a 60 degree slope edge and a flat bottom spaced in such a manner as to circumscribe the air passage wall no more than one and three-quarter revolutions. This grooved surface terminates prior to the exit of the lower passage located at the bottom of the spacer plate. The bottom diameter of the passage shall contain a 30 to 45 degree chamfer.

The instant invention is more compatible with factory engineered internal combustion engine structure while at the same time adding to the homogenization of the mixture resulting in even more horsepower, torque, etc. than that generated by earlier inventions.

As a further advantage, and unlike existing spacer plates now available, the positive attributes of the present invention do not decrease or fluctuate as engine RPM and intake air velocity increase. This invention maintains a reasonably constant frequency and flow preventing excessive degradation of the air flow characteristics. Therefore, the invention does not favor a narrow RPM operating band but, to the contrary, operates efficiently at all operational ranges and for application in any internal combustion engine, as opposed to limited applications.

DETAILED DESCRIPTION OF THE INVENTION

Figure 1:
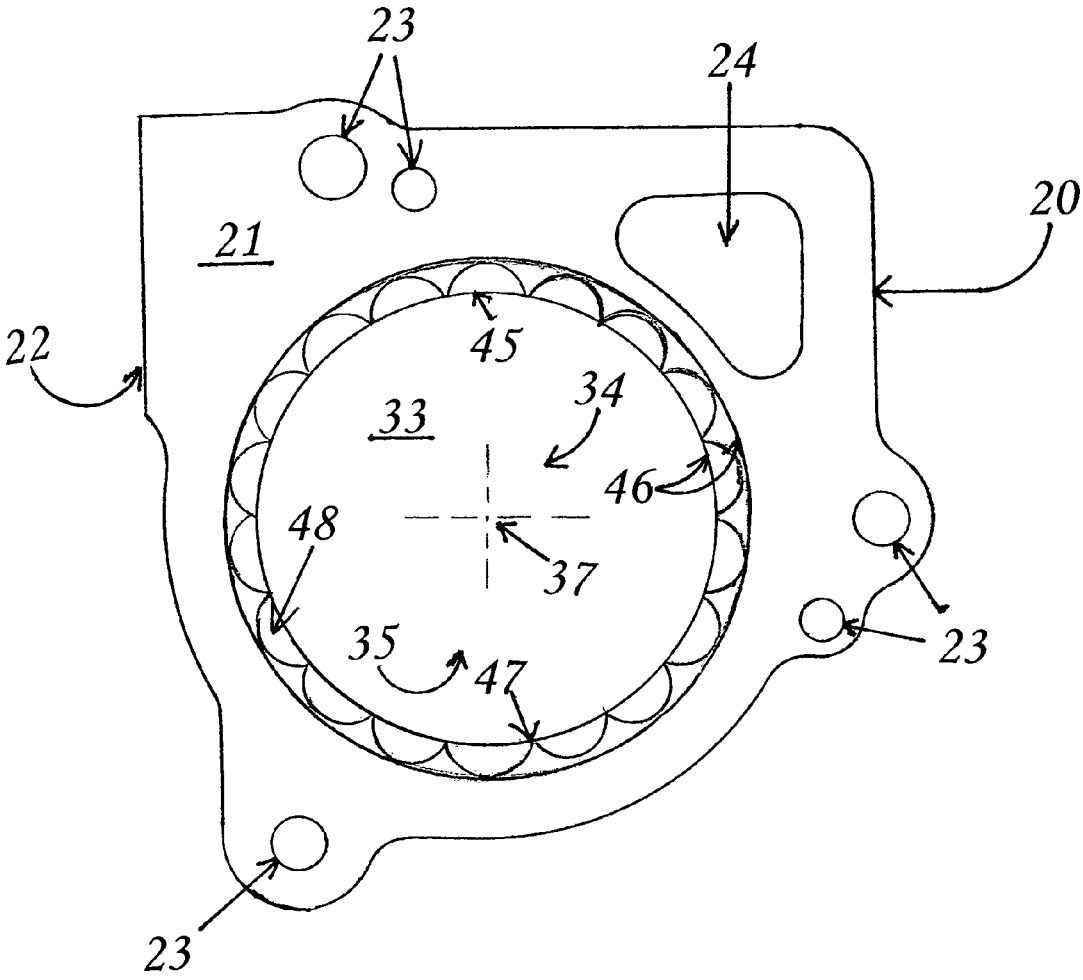
FIG. 1 is a detailed top perspective view of a device according to the present invention.
Figure 2:
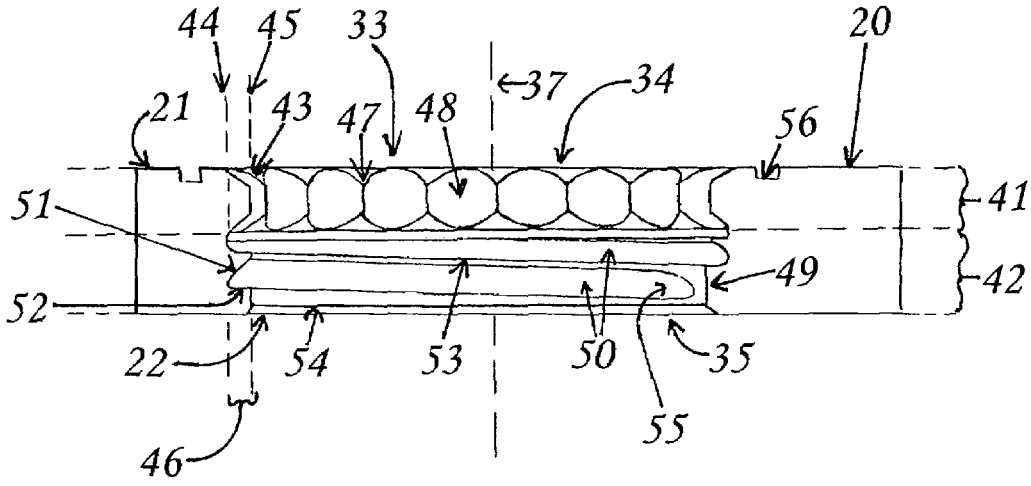
FIG. 2 is a detailed cross-section perspective view of a device according to the present invention.
Figure 3A:
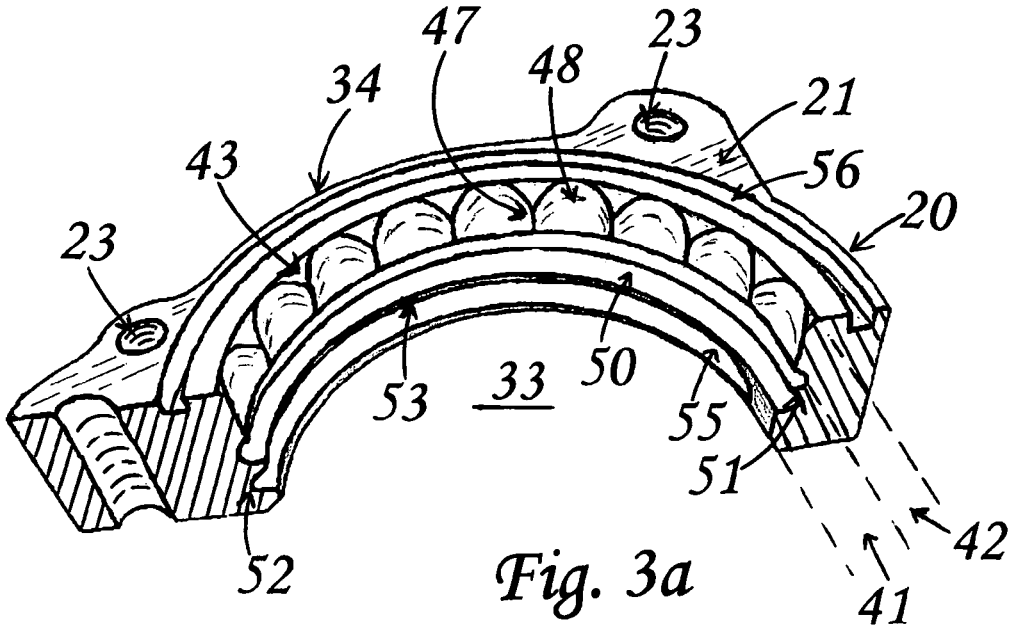
FIG. 3*a* is a top cross-section perspective view of a device according to the present invention
Figure 3B:
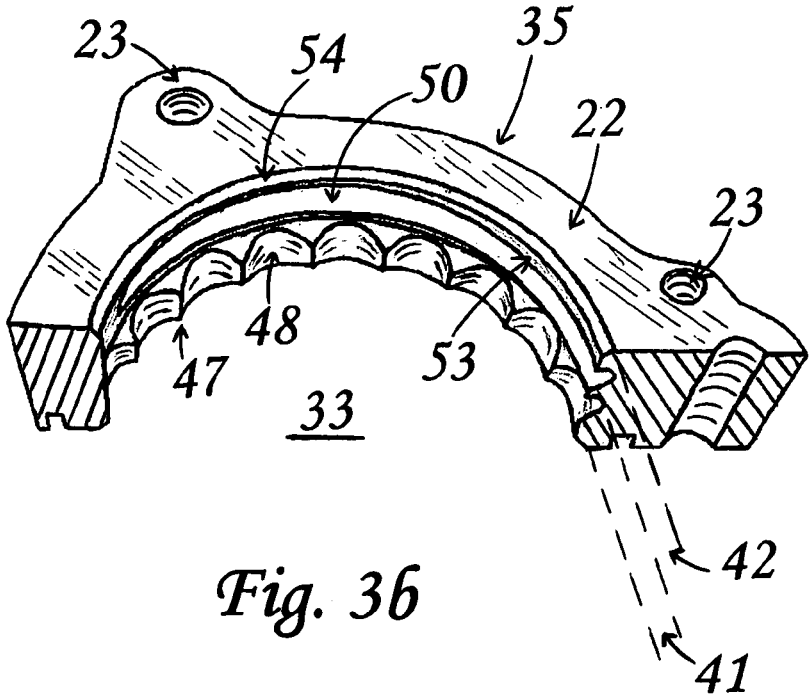
FIG. 3*b* is a bottom cross-section perspective view of a device according to the present invention.

The present invention shall generally be described with reference to FIGS. 1, 2, 3*a* and 3*b*. FIG. 1 is a detailed top perspective view of a device according to the present invention. Cross-sectional views of the device are shown in FIG. 2, 3*a* and 3*b*. FIG. 2 is a detailed cross-section view of a device according to the present invention. FIG. 3*a* is a top cross-section perspective view and FIG. 3*b* is a bottom cross-section perspective view of a device according to the present invention.

One skilled in the art will recognize that the device shown in FIGS. 1, 2, 3*a*, and 3*b* may be a part of any device (e.g. spacer, adaptor, riser, etc) for use with the intake path in any internal combustion engine. For example, such devices may be utilized in an intake path used with either a carburetor, throttle body injectors, or direct injectors in various applications such as trucks, automobiles, tractors, etc. As will become apparent from the description below, the present invention is not restricted to any particular illustrative example shown in the drawings.

FIG. 1 illustrates a top view of an embodiment of a spacer device 20 which is constructed of billet aluminum material of 1.0 inch thickness. The thickness may vary from 0.75 inch to 2.00 inches. Such spacer may also be constructed of other materials such as plastic, rubber, phoenelic resin, metal, etc. The length, width, and detail of the design will vary depending on the application.

The spacer device 20 has a defined top surface 21 and bottom surface 22; such surfaces being parallel to one another, as better shown in FIG. 2. The airway passage 33 includes an inlet opening 34 defined at the top surface of the spacer body 21 and an outlet opening 35 defined at the bottom surface of the spacer 22, such airway passage running parallel to the center axis 37 of such passage. Generally, the size of the inlet opening and outlet opening may vary depending upon corresponding air intake path structures, and the openings defined therein. In addition, there may be additional airway passages of the same or similar nature located in the device as required by the internal combustion engine application specifications.

A plurality of holes 23 are defined through the device and positioned to accommodate the bolts which connect the air intake structure to the air intake manifold The placement of these holes varies according to the air intake systems's specifications. Utilizing existing or purchased hardware, the spacer 20 will be positioned using existing mounting holes of an intake system for the internal combustion engine.

Other openings 24 may also be defined through the device and positioned to accommodate the inlet and outlet ports in the air intake system. These openings accommodate pass-through air and/or suction flow in the air intake system. Alignment and seal of these openings is necessary with the placement of these openings in the spacer dictated by the intake system's specifications.

It is critical that the insertion of this device establish an airtight seal within the engines air intake system. To establish this seal, the device may be installed using a gasket form cut to the specifications of the spacer device. The footprint of this gasket will correspond to the dimensions of the spacer as shown. The gasket will likewise contain bolt holes 23 and cutouts for openings 24 which correspond to the holes and openings found in the upper and lower sections of the air intake application, and the spacer device. An alternative method for installing a gasket is shown in FIGS. 2 and 3*a*. Here, this gasket is formed by the insertion of an O-ring type rubber insert into a U-shaped grove 56 defined in either the upper or lower surface of the spacer, or both.

As shown in FIG. 2, the spacer 20 has a defined top surface 21 and bottom surface 22; such surfaces being substantially parallel to one another. The airway passage 33 includes an inlet opening 34 defined at the top surface of the spacer body 21 and an outlet opening 35 defined at the bottom surface of the spacer body 22. The airway passage surface contains two distinctive geometric designs described as follows.

The upper portion 41 of the passage surface shall contain an initial 30 to 45 degree chamfer 43 with the outer diameter 44 of the upper portion of the passage surface 41 larger in diameter than the inside diameter 45 of lower portion of the passage surface 42 described below. This upper and lower airway passage diameter difference 46 is also shown from a top view in FIG. 1

After the initial chamfer, the upper portion of the airway passage surface 41 shall thereafter consist of multiple symmetrical vanes 47 which run parallel to the center axis 37, and which project into the airway passage 33. The formation of these multiple vanes 47 consists of the joiner of U-shaped passages 48 existing in the passage surface and which likewise run parallel to the center axis 37 of the airway passage. The above configuation of the upper portion of the air flow passage 41 establishes an unobstructed, but directed, flow of air for introduction to the lower portion of the passage 42 described below.

The second, or lower, portion of the air passage 42 contained in the present invention consists of a passage inside diameter 45 smaller than the upper portion outside diameter 44. The lower portion 42 inside airway passage diameter 45 shall protrude into the airway passage 33 at a depth at least equal to the innermost edge of the upper portion vanes 47 described above.

The wall of the lower portion of the air passage 49 further defines a grooved surface 50 beginning at the top of the lower portion 42, such grove having a 60 degree slope edge 51 and a flat bottom. 52. The referenced groove 50 has a helical shaped pattern which is spaced in such a manner as to circumscribe the lower passage wall 49 no more than one and three-quarter revolutions. Such groove terminates 55 prior to the bottom of the spacer plate 22. At a point of the groove overlap 53, such grooves are parallel to, but independent of, the other and spaced at a minimum of between $\frac{1}{8}^{th}$ to $\frac{1}{16}^{th}$ inch from the other. The bottom diameter of the passage shall contain a 30 to 45 degree chamfer 54, depending upon the specifications of the application.

FIGS. 3*a* and 3*b* show a cross-section perspective of the device. As shown in FIGS. 1 and 2, the spacer device 20 has a defined top surface 21 and bottom surface 22; such surfaces being substantially parallel to one another. The airway passage 33 includes an inlet opening 34 defined at the top surface of the spacer body 21 and an outlet opening 35 defined at the bottom surface of the spacer body 22. The interior design of the airway passage surface is divided into two sections, the upper portion 41 and the lower portion 42.

The upper portion 41 of the passage surface shall contain an initial 30 to 45 degree chamfer 43. There is a distinct lower and upper airway passage diameter difference 46 which is shown in FIGS. 1 and 2.

After the initial chamfer, the upper portion of the airway passage surface 41 shall thereafter consist of multiple symmetrical vanes 47 project into the airway passage 33. The formation of these multiple vanes 47 consists of the joiner of U-shaped passages 48 existing in the passage surface and which run parallel to the center axis of the airway passage.

The second, or lower, portion of the air passage 42 contained in the present invention consists of a passage inside diameter smaller than the upper portion outside diameter. The lower portion 42 inside airway passage diameter shall protrude into the airway passage 33 at a depth at least equal to the innermost edge of the upper portion vanes 47 described above.

The wall of the lower portion of the air passage 49 further defines a grooved surface 50 beginning at the top of the lower portion 42, such grove having a 60 degree slope edge 51 and a flat bottom. 52. The referenced groove 50 has a helical shaped pattern which is spaced in such a manner as to circumscribe the lower passage wall no more than one and three-quarter revolutions. Such groove terminates 55 prior to the bottom of the spacer plate 22. At a point of the groove overlap, such grooves are parallel to, but independent of, the other and spaced at a minimum of $\frac{1}{16}^{th}$ inch from the other. The bottom diameter of the passage shall contain a 30 to 45 degree chamfer 54, depending upon the specifications of the application.

An alternative method for installing a gasket is shown in FIG. 3*a*. Here, the gasket is formed by the insertion of an O-ring type rubber insert into a U-shaped grove 56 defined in either the upper or lower surface of the spacer, or both.

The above invention incorporates a realignment and stabilization of the air flow exiting from the air passageway from the air filter and the introduction of such air flow to a size reduction in the passage wall, introduced by a vertically aligned surface and extending such flow over the planner surface of the internal diameter of the passage, as interrupted by the recessions, or retention spaces, caused by the grooved surfaces. The pressure differential created by the passage of air over such combinations of planar surfaces and retention surfaces, induces an artificial pressure increase which causes the air volume to then expand into the retention space with more volume, hence less pressure. In effect, the outer portion of the directed air flow is then incorporated into the bulk of the air flow with the creation of intra-volume dimensional eddies. This rapid acceleration/deceleration sequence permits delivery of the micro-infused air force to receive fuel creating a more homogenized fuel mixture into the factory production intake manifold and combustion chamber with pre-defined dimensions and design characteristics. This pressure manipulated fuel/air mixture containing artificially generated micro features greatly aids in combustion.

The preceding specific embodiments are illustrative of the practice of the invention. It is to be understood, therefore, that other expedients known to those skilled in the art or disclosed herein may be employed without departing from the invention or the scope of the appended claims. For example, a device according to the present invention may include or incorporate any number of the illustrative configurations as described herein, or the exterior or interior dimensions of the device may vary dependent upon the design characteristics of the intake manifold, plenum, fuel injection devices and locations, or other variations commonly encounter in internal combustion engines. As such, the present invention includes within its scope other methods of implementing and using the invention described herein above.

What is claimed is:

1. A device for use with an internal combustion engine comprising:

(a) a body portion having a top and bottom surface; and, (b) at least one passage surface defining at least one passage about an axis from the top surface to the bottom surface through the body of the device, wherein the passage has an inner circumference surface divided into two equal and distinct portions; and, (c) the upper portion of the passage surface defines a plurality of veins continuously about the inner circumference surface of the passage, and were such veins are parallel to an axis of the passage; and, (d) the lower portion of the passage surface having an outside diameter smaller than the inside diameter of the upper portion of the passage and defining a helical grove beginning at the top of the lower portion of the passage surface and terminating prior to the bottom of the lower portion of the passage surface.

2. The device of claim 1, wherein the groove in the lower portion of the passage surface is helical in shape and has a 60 degree slope edge and a flat bottom.

3. The device of claim 2 wherein the body portion of the spacer contains a U-shaped groove in either the lower surface region or the upper surface region, or both, and which accepts a continuous O-ring style gasket.

4. The device of claim 2, wherein the body portion of the spacer contains holes and openings to accommodate the bolt and airway passages of the intake manifold application.

* * * * *